United States Patent [19]

Tsai

[11] Patent Number: 4,805,329

[45] Date of Patent: Feb. 21, 1989

[54] SELF-POWERED COMPUTERIZED ADVERTISEMENT BOARD

[76] Inventor: Hung-Chie Tsai, No. 26-4 Shuang-Cheng St., Taipei, Taiwan, 104

[21] Appl. No.: 65,138

[22] Filed: Jun. 25, 1987

Related U.S. Application Data

[63] Continuation of Ser. No. 795,171, Nov. 5, 1985, abandoned.

[51] Int. Cl.[4] ..... G09F 13/28

[52] U.S. Cl. ..... 40/550; 40/447; 40/553; 340/134; 362/190; 290/55; 446/217

[58] Field of Search ..... 40/550, 553, 447; 362/190; 340/134; 350/97, 98, 99, 105; 290/55; 446/217, 218, 485

[56] References Cited

U.S. PATENT DOCUMENTS

| | | | |
|---|---|---|---|
| 759,732 | 5/1904 | Mills | 446/218 |
| 882,555 | 3/1908 | Doane | 40/550 |
| 1,034,442 | 8/1912 | Hanley | 40/550 |
| 1,734,858 | 11/1929 | Keller | 446/217 |
| 1,850,285 | 3/1932 | Miller | 40/550 |
| 1,876,595 | 9/1932 | Beldimano | 290/55 |
| 3,621,930 | 11/1971 | Dutchak | 290/55 |
| 3,675,364 | 7/1972 | Halpern | 446/218 |
| 3,974,369 | 8/1976 | Chmela et al. | 362/190 |
| 4,045,122 | 8/1977 | Burdick | 350/97 |
| 4,120,561 | 10/1978 | Burkholder | 350/97 |
| 4,204,746 | 5/1980 | Fisher | 350/97 |
| 4,220,870 | 9/1980 | Kelly | 290/55 |

FOREIGN PATENT DOCUMENTS

| | | | |
|---|---|---|---|
| 2710146 | 9/1978 | Fed. Rep. of Germany | 40/553 |
| 151442 | 9/1982 | Japan | 340/134 |

*Primary Examiner*—Robert Peshock
*Assistant Examiner*—J. R. Hakomaki
*Attorney, Agent, or Firm*—Bacon & Thomas

[57] ABSTRACT

A self-powered computerized advertisement board is disclosed which utilizes a plurality of wind-driven illuminating units to provide the requisite electrical power. The invention includes an electrical power handling circuit and a control circuit to store and distribute the electrical power and to control the illumination of the bulbs associated with the wind-driven illuminating units.

5 Claims, 8 Drawing Sheets

SELF-POWERED COMPUTERIZED ADVERTISEMENT BOARD

This application is a continuation of application Ser. No. 795,171 filed 11-5-85 now abandoned.

BACKGROUND OF THE INVENTION

Advertisement boards are, of course, well-known and are often provided with neon light illuminating units to optimize the advertisement effects. However, such advertisement boards require rather expensive electrical power costs and the flashing patterns are repetitive which tend to minimize their attractiveness to the customer over a period of time.

SUMMARY OF THE INVENTION

The present invention obviates the problems of the prior art devices by providing an advertisement board which needs no connection to an external power supply. The invention utilizes a wind force to rotate a plurality of fan blades which are arranged in a predetermined pattern of characters or letters. The rotation of the fan blades drives small electrical power generators. The electrical power generated by all of the generators is collected together and serves as a power supply for a control circuit which controls the illumination of each of the individual light bulbs.

The control system is such that it illuminates one or only a few of the bulbs at any given time, but due to the residual vision phenomenon, the viewers of the advertisement board are given the impression that all of the bulbs are alight. In this way, the power supply collected from all of the relatively small power generators provides the power supply required by the advertisement board and the control circuit.

A reflective color may be coded on the fan blades to reflect external light when the wind force drives the fan into rotation which, due to the perceived flashing, serves to further attract the viewers attention to the board.

The invention also incorporates one-way clutch means to insure that the fan blades rotate in only a given direction and, when no wind is blowing, the fan blades will be shaken arbitrarily so that all of the light reflected from the fan blades can be concentrated together without any disordered dispersion.

The fan blades are attached to a hollow shaft which is also connected to the electrical power generating means. As the shaft rotates the generator produces electrical power. A housing surrounds this structure and is inserted generally perpendicularly to the advertising board such that the fan blade extends exteriorly of the advertising board surface. The wind acting on the fan blades produces the electrical power output and the fan blades also absorb a portion of the wind force and redirect it to another angle. This diminishes the effects of the wind force acting on the advertisement board face which may extend the life of such advertisement boards.

The invention also includes an electric power storage circuit means to store the electrical power generated by the plurality of the small power generators.

The invention also includes control means to make the advertisement lights illuminate at a predetermined time and for a predetermined duration. The control means includes a micro-processor device which uses a single chip micro-computer to minimize its power requirements. The control means has a data input means to enable the time and duration of the illumination of the lights to be easily set and to be easily changed at a later time. The input data means may be located remotely from the advertisement board and have known signal transmission means interconnected between them to effect the data input to the data storage means. Thus, the advertising board according to the invention is readily changeable with regard to its flashing patterns to maintain the interest of the observers.

In order to maintain operation of the advertisement board during extended peridds of very low or calm winds, an auxiliary, commercial power device is incorporated. When the electrical power storage means reaches a predetermined level, the system automatically switches over to the commercial power unit to continuously maintain the normal working of the advertisement board.

DETAILED DESCRIPTION OF THE PREFERRED EMBODIMENTS

The advertisement board according to the invention achieves superior results over the prior art devices in economy, esthetics and advertisement effects. The advertisement board described herein generates its own electrical power supply and is self-powered. Unlike the conventional boards, it does not require a large amount of power expenses to maintain its operation and is, therefore, generally more economical than existing items.

The patterns or characters defined by the arrangement of the fan blades can be driven into rotation by the force of the wind acting on them and a variety of colors applied to the fan blades provides increased esthetic effects over the prior art. Moreover, the colors coded on the fan blades may be reflective, thereby further enhancing their esthetic effects.

The advertisement effects of the present board is also increased over the prior art devices since the flashing regularity of the advertisement lights can be planned and altered with exceptionally good effects.

Figure 1:
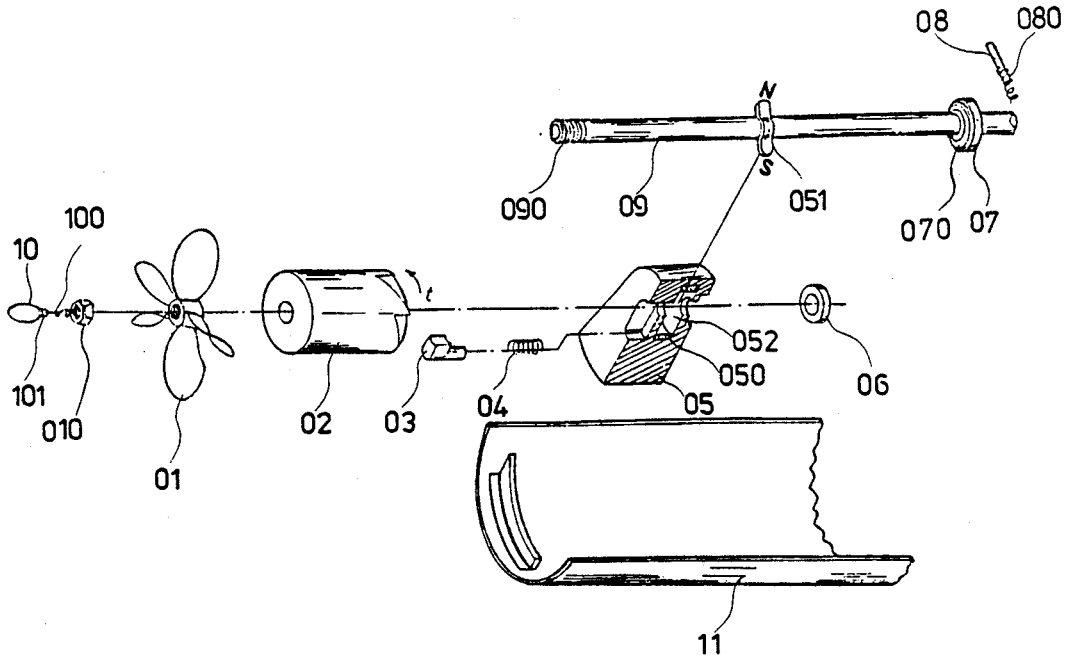
FIG. 1 is an exploded perspective view of the illuminating unit according to the invention.

FIG. 1 shows an exploded, schematic view of the illuminating unit utilized in the advertisement board according to this invention. Numeral 01 designates a fan blade which is rotated by the force of the wind acting thereon. A hollow, rotary shaft 09 is mounted within housing 11 and extends through rotary cylindrical means 02 and the fan blade 01. Nut 010 is threaded onto portion 090 of the shaft and bulb 10 can be attached therein by end portion 101. An arcuate plate 07 is fixed on the shaft 09 and has an insulation ring 070 positioned therebetween. A brush, such as spring 080 and the arcuate plate 07 form a means by which a terminal 100 of the light bulb 10 can be led out of the illuminating unit. The rotary cylindrical means 02, comprises a one-way clutch means which, when engaged by pawl 03 limits the rotation of the shaft to a single direction. Engagement of the pawl 03 with the sawtooth end portion of the cylindrical means 02 effectively precludes reverse rotation of the shaft. A small power generator 05 comprises a coil 050 and a rotary magnet 051 which rotates with the shaft 09 in cavity 052 formed in the power generator 05.

Figure 2:
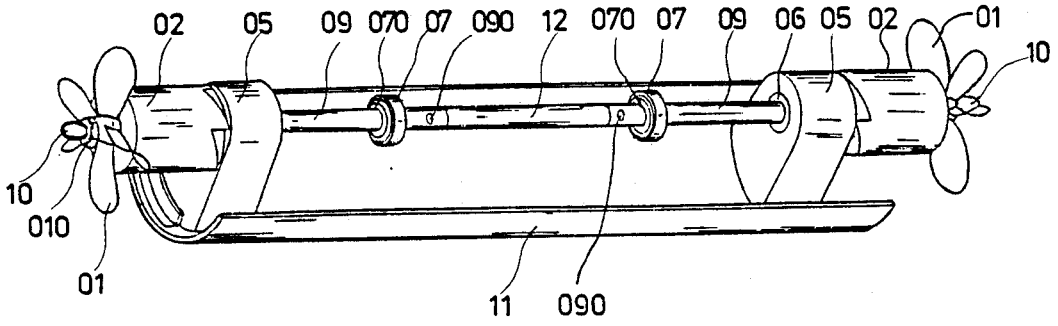
FIG. 2 is a perspective, partially cutaway view showing an alternative embodiment of the illuminating unit according to the invention.

FIG. 2 discloses a modified form of power generator in which a fan blade 01 is located on either end of shaft 09. Connector 12 joins the two fan blade shafts 09. The operation of the device as well as the one-way clutch mechanism and the power generators are the same as that previously described in reference to FIG. 1.

Figure 3:
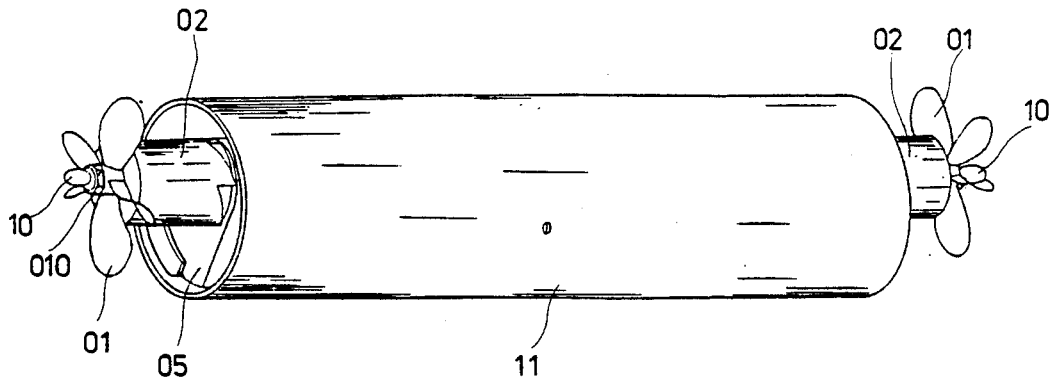
FIG. 3 is a perspective view of the illuminating unit shown in FIG. 2.

FIG. 3 shows a perspective view of the device of FIG. 2. In use, a hole is formed through the thickness of the advertisement board and housing 11 is inserted therein such that the fan blades extend outwardly from either side of the board. The entire housing 11 and the devices located within it are all located within the advertisement board and only the fan blades protrude therefrom.

A small section on each end of the housing body 11 may be made transparent and additional lighting bulbs placed in the advertisement board, or the light bulb 10, will generate light which can go through the transparent portion and shine on the reverse side of the fan blades.

Figure 4:
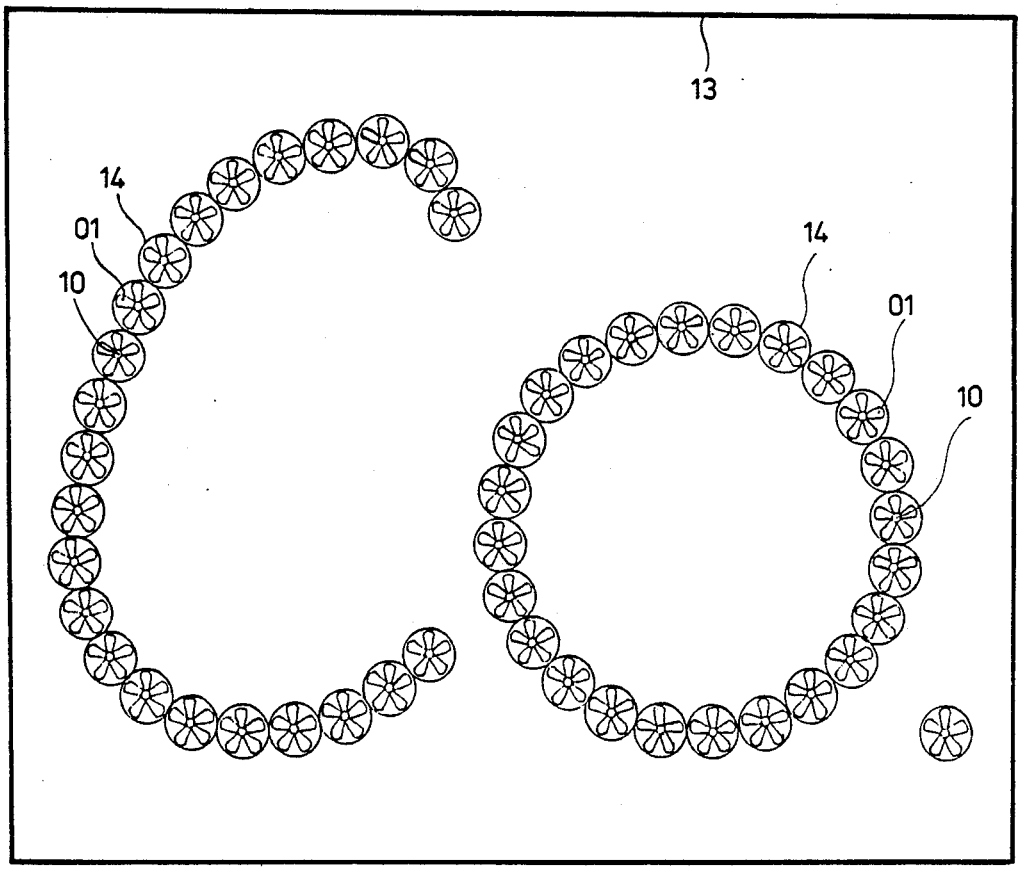
FIG. 4 is a front, elevational view of the advertisement board incorporating the illuminating units of the invention.

FIG. 4 shows a plurality of the illuminating units arranged into the characters "C" and "o". The advertisement board is designated by the numeral 13, while 14 designates the holes provided through the advertisement board for the illuminating units. Quite obviously, the illuminating units can be arranged in any fashion on the advertisement board which is desired by the user.

Figure 5:
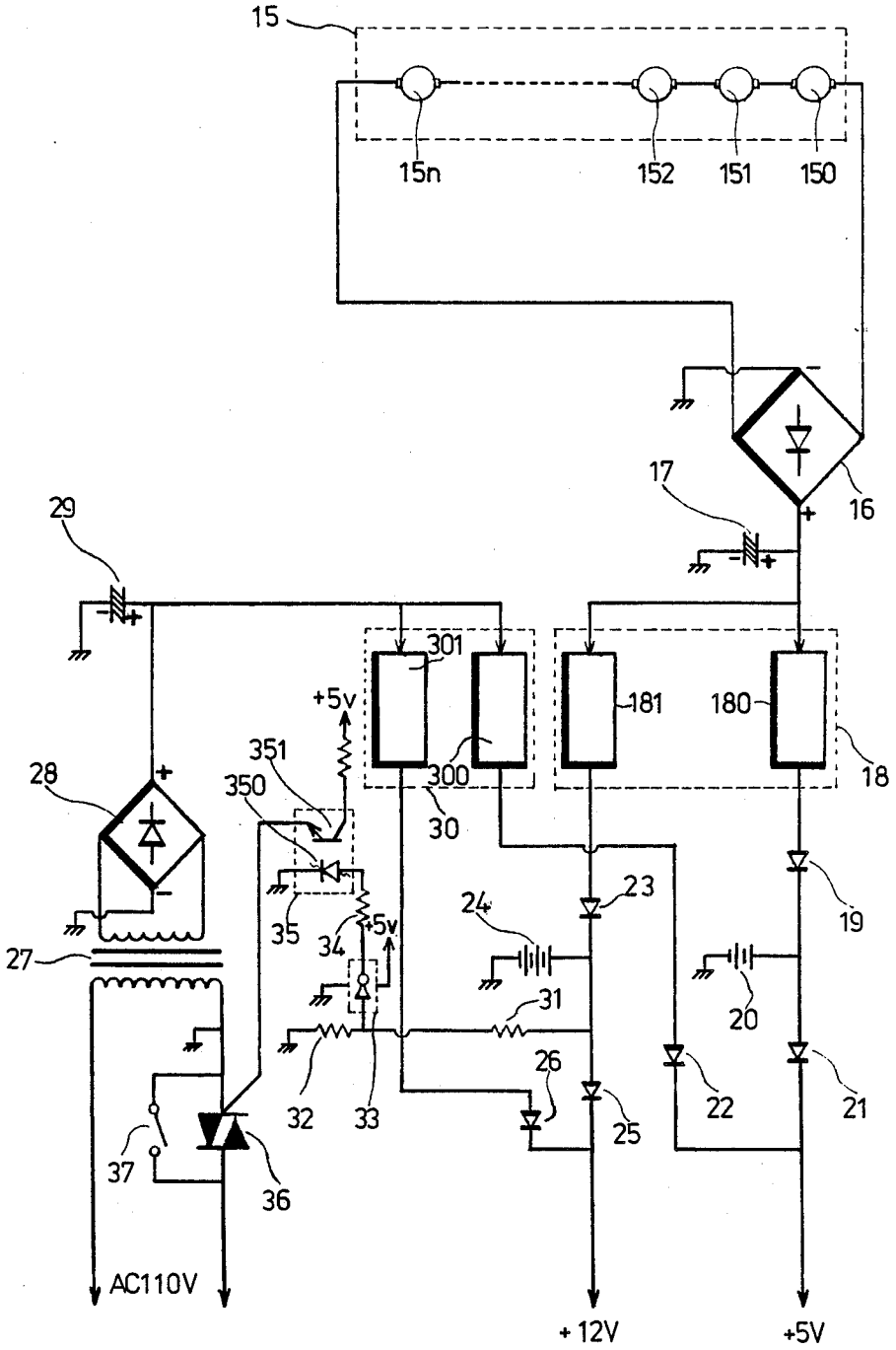
FIG. 5 is a schematic diagram of the power supply handling system according to the invention.

FIG. 5 shows a schematic diagram of the power supply handling circuit for the power supply of the control circuit and the light bulbs. The block 15 denotes the circuit connection diagram of the sum of the voltages produced by the individual small power generators 05, which circuits are connected in series. 150–15n denote the sum of all of the small generators. 16 denotes a full-wave rectifier and 17 designates a filter for the AC power supplied by block 15. 18 is a voltage stabilizer in which 180 designates a circuit of a 5-volt voltage stabilizer to serve as a power supply for the power supply control. 181 designates a circuit of the 12-volt (or higher) voltage stabilizer to illuminate the advertising light bulbs. Numeral 20 designates a 5-volt battery of the rechargeable type, while diode 19 prevents the reversal of current flow into voltage stabilizer 180 from the battery 20.

24 designates a 12-volt (or higher) battery, also of the rechargeable type, with diode 23 preventing the current from flowing from the battery into the voltage stabilizer 181.

The circuit network formed by elements 27–37 is an automatic change-over device for the household commercial power supply. Numeral 27 designates a transformer, 28 a full-wave rectifier, and 29 designates a filter-capacitor. Voltage stabilizer 30 is similar to that designated by 18. 300 designates a 5-volt voltage stabilizer while 301 is the 12-volt (or higher) voltage stabilizer. Elements 31 and 32 designate voltage divider resistors.

When the battery 24 has stored sufficient power to illuminate the advertisement bulbs 10, resistor 32 has a sufficient voltage level to change the output of phase inverter 33 from high to low. Current limiting resistor 34 is coupled with optical coupler 35 having LED 350 and a transistor 351. Element 36 designates a two-way silicon control transistor, while 37 is an alternate switch which may be directly switched to the on position when the control of the automatic change-over becomes defective and the power stored in battery 24 is insufficient.

When the power stored in battery 24 is insufficient, the output of phase inverter 33 will be high, therefore LED 350 is illuminated. This enables the transistor 351 to supply the 110V AC power to the bulbs 10 via the control signal of the ON of the transistor 351. Diodes 21, 22, 25 and 26 prevent the mutual electric current flow between voltage stabilizers 18 and 30.

Figure 6:
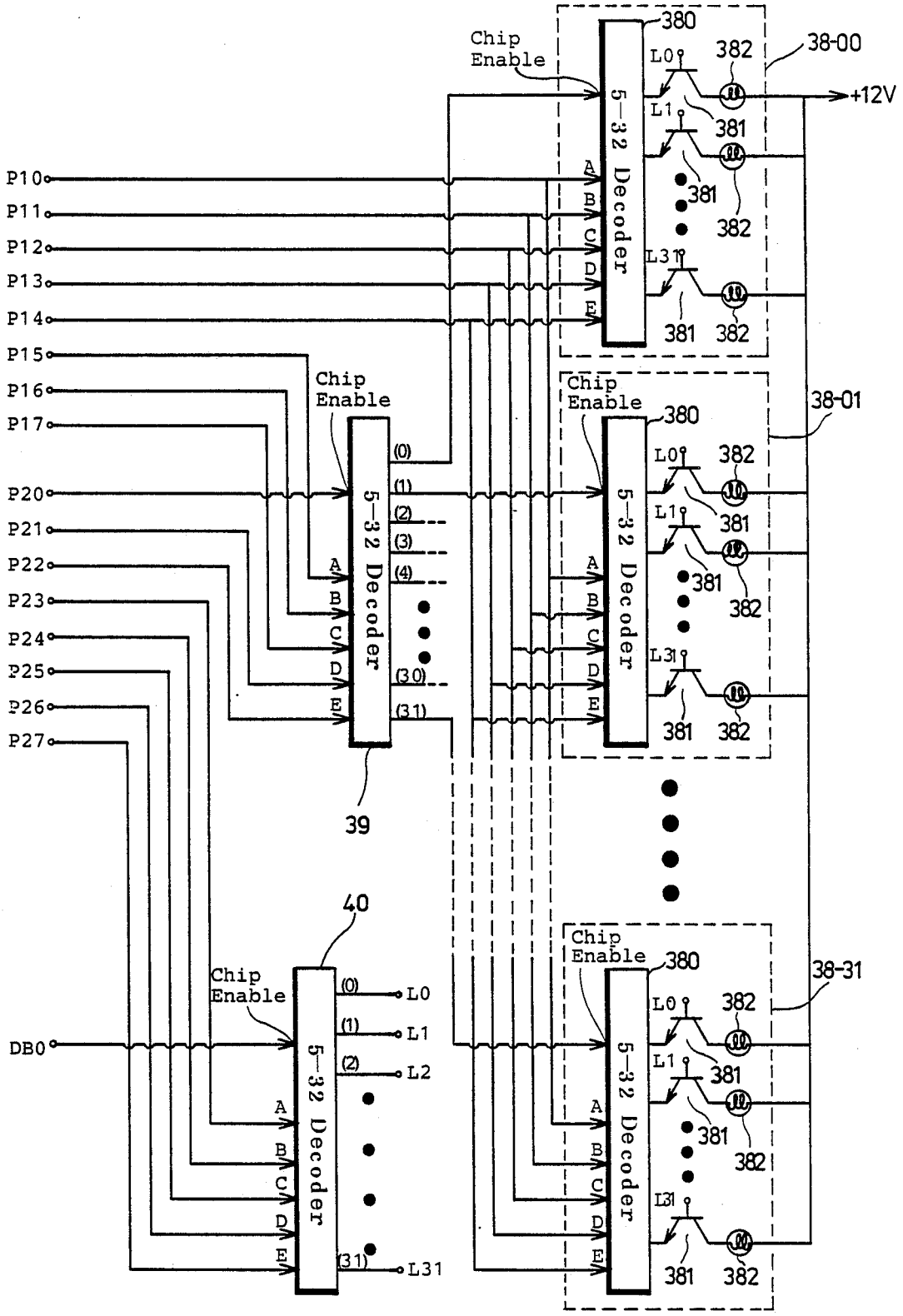
FIG. 6 is a circuit diagram showing the interconnections of the advertising bulbs according to the invention.

FIG. 6 is a schematic diagram showing the connection for the circuits of the advertisement board. Each of the groups 38-00 to 38-31 contains thirty-two advertisement bulbs 382, respectively. Each group of them can be arranged in a letter or character form, although if the letter or character does not require all of the thirty-two bulbs, the remainder can be disconnected from the power supply. Each of the bulbs 382 is driven by a transistor 381, respectively.

Numeral 380 in each of the groups 38-i (wherein i =00,01, . . . ,31) designates a 5-32 decoder. At any given time during the operation of the advertisement board, only one of these decoders is operative, the operative decoder being selected and determined by another 5-32 decoder designated by numeral 39. At the time when one decoder in groups 38-i selected by decoder 39 is working, another 5-32 decoder 40 rapidly and alternately selects one from 10-131 as high. Thus, in such cross operations, only one bulb is selected from the totality of the bulbs and illuminated.

When the decoder 39 selects a decoder 380 from the groups 38-i, it must pause for a predetermined time to let the output terminals (0)–(31) on decoder 40 alternately effect its output high once. In this way, the bulbs will be illuminated to insure that the viewers vision will give the impression that the entire letter or character is fully illuminated. If the scanning speed is sufficiently fast, the viewer is given the impression that all of the letters or characters are alight. However, if, after only one letter or character is scanned repeatedly and continued for many times and then stops for a predetermined time before scanning the next letter or character, the viewer will feel that the letters or characters are sequentially alighted.

The control of the information changing situation of terminals $DB_o$, P10–P17 and P20–P27 achieves the above-mentioned objectives. The aforementioned terminals may be controlled by the software associated with the control system.

Figure 7:
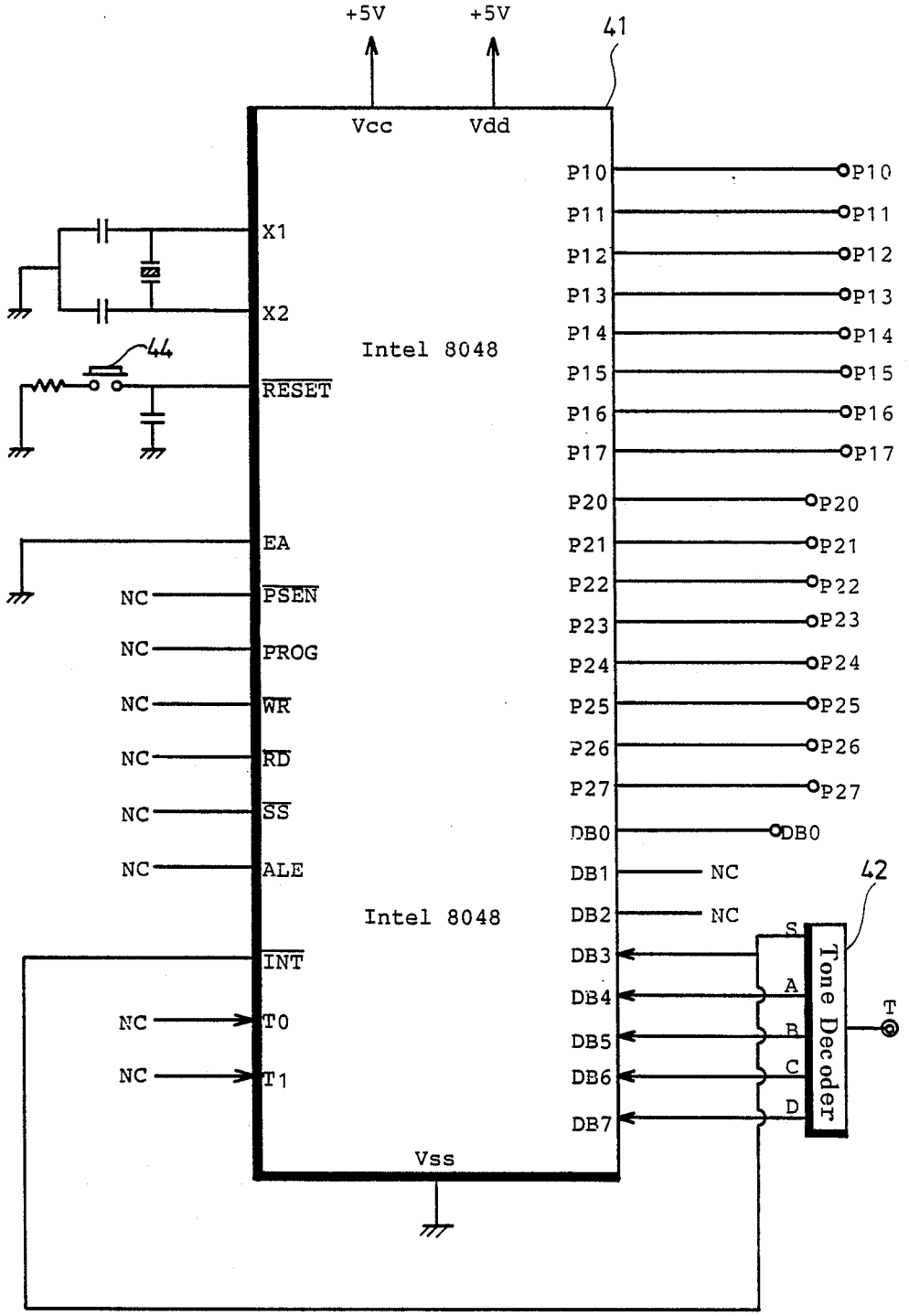
FIG. 7 is a schematic diagram of the microcomputer control system for controlling the circuit shown in FIG. 6.

FIG. 7 shows the computer control system which may utilize an Intel Co. 8048 computer having a 64-byte RAM comprising a CPU and a ROM, a timer containing 8 bits and three micro-computer single chips for I/O ports.

In the drawing, numeral 41 designates the above identified micro-computer while 42 designates a tone decoder for demodulating the multiple frequency signals transmitted by an external source into binary signals. 43 designates a transistor oscillator while terminals P10–P17, P20–P27 and $DB_o$ are terminals to be connected to similarly identified terminals in FIG. 6. A division of the RAM in the 8048 computer is necessary in order to provide the regularity of the lighting of the advertisement bulbs and to effect the automatic changes in the lighting of the bulbs. The first section of RAM comprises a plurality of groups with each containing one or more bytes, the data stored by each group in advance can instruct the regularity of the advertisement bulbs to be illuminated such that the results of the arrangement of this section of RAM forms the regular change procedure. To expedite the design and description of the software flow, the indicator DM is used to indicate the starting point of this section of the RAM.

The second section of RAM also contains a plurality of groups with each having only one byte, each byte corresponding to each respective group in the first section of the RAM. The data it contains serves as the indication for the number of scanning, i.e., when the advertisement light bulb is regularly illuminated, the related duration serves as its lighting time. This start time is expressed by the indicator DM2. The third section of the RAM also comprises a plurality of groups with each having only one byte, each byte also corresponding to each respective group in the first RAM section. The data it contains serves to indicate the period of non-illumination of the advertisement light-bulb. Its start point is expressed by the indicator DM3.

Some RAMs are required to store the storage time keeping and timing records, and a flag Fl can indicate the time that the time keeping records enter the scope of the timing records.

A counter as expressed by CM is required, its start value being the number of groups in the above lst–3rd sections of the RAM.

Figure 8:
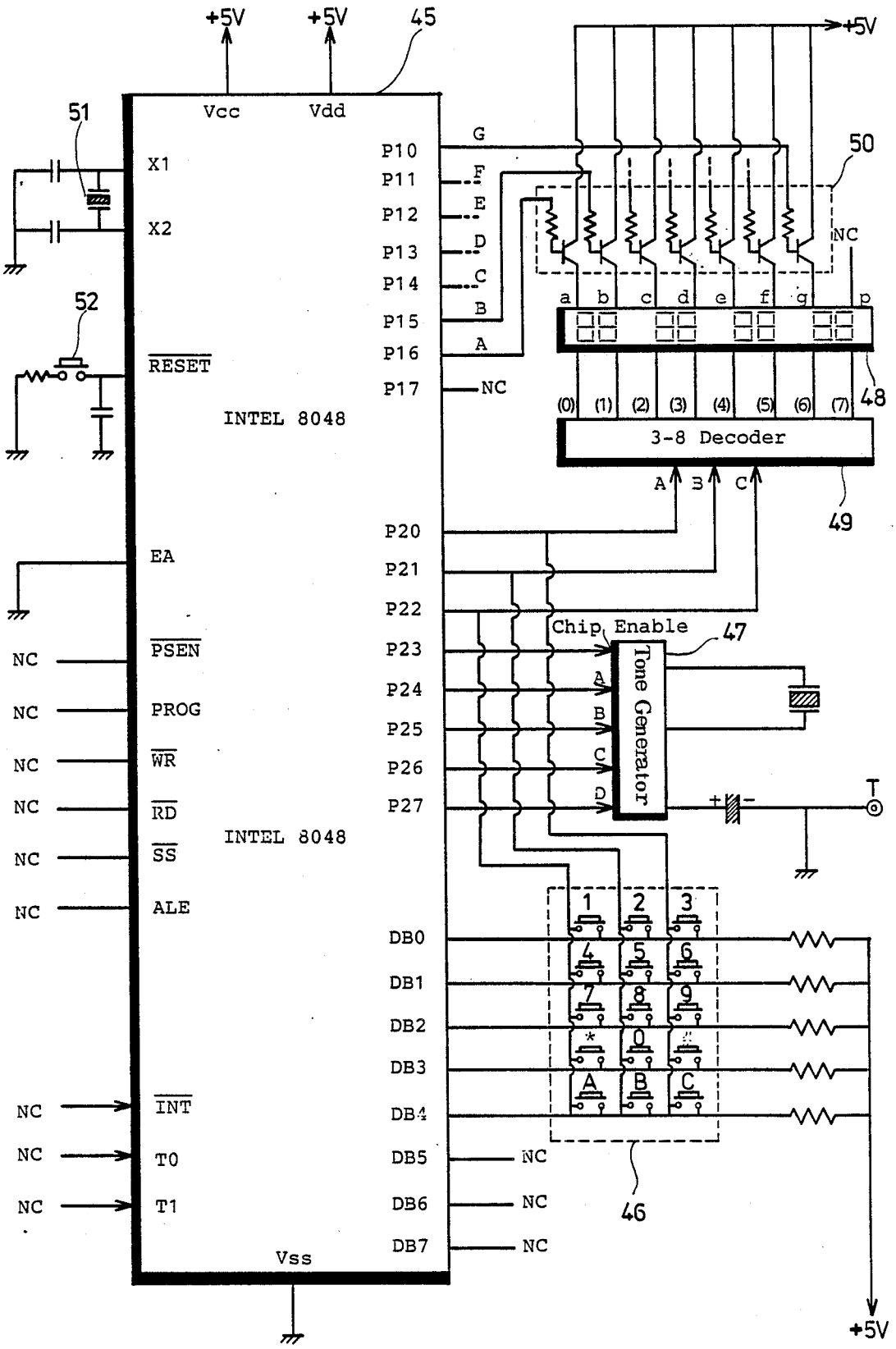
FIG. 8 is a schematic diagram of the microcomputer system utilized to input data into the control system shown in FIG. 7.

FIG. 8 is a schematic diagram of the data input system which utilizes another micro-processor, which may also be an Intel 8048. This system may be remotely located from the advertisement board and the data transferred to the board through tone generator 47. The tone generator converts the signals into multiple frequency signals which are then transmitted to terminal T shown in FIG. 7. Numeral 45 designates a single chip micro-computer similar to that shown at 41 in FIG. 7. Terminals P10–P16 are used as a Data Bus for supplying a 7-segment data of the display 48 which contains 8 digital figures. Terminal P17 is not utilized.

Terminals P20–P22 have two uses, the first is that when the display 48 displays, it serves as a display to select the bulb desired to be illuminated; and the other is when the key is read, it supplies a scan signal for the keyboard. The display program can be designed as a separate routine, and after the displays of all of the 8 figures are alighted alternately for one week, terminals P10–P16 are reduced to LOW, then the key is read. During reading the key in this way, the figures in display 48 will not be chaotically and critically alight and during the display work process, since the program does not observe the $DB_o$–$DB_4$.

Terminal P23 serves as the control lines for the Chip Enable of the tone generator 47 to convert the binary codes into multiple frequency signals. Terminals P24–P27 supply the binary code data to the tone generator 47. Terminals $DB_o$–$DB_4$ serve as the Sense Lines when the key is read, while terminals $DB_5$–$DB_7$ are not utilized.

Display 48 comprises four groups of $D_o$–$D_3$, each of which has two digit displays. $D_o$ is referred to as the data situation indicator. Numeral 49 designates a 3–8 decoder.

The keys of keyboard 46 perform various functions. Keys 0–9 are the conventional figure keys. Key * is the data record situation selection key and when this key is pressed repeatedly, the changes in display 48 are as follows:

(a) At the start, indicators $D_0=D_{10}$, $D_1$–$D_3$ are determined by the digit key. When the digit key is depressed, its corresponding digit will enter the rightmost digit display position. Those originally having indicator $D_1$–$D_3$ will simultaneously move to the next place to the left and the digit originally in the left of indicator $D_1$ is eliminated.

(b) During the 1st–9th times, indicator $D_0$ will gradually and progressively increase from 11 to 19 and when the digit key is depressed, the result will be the same as that discussed above. The above digits of indicator $D_1$ indicate the number of the advertisement bulbs that are scanned when they are alight and $D_8$ indicates the time that the bulbs are illuminated. $D_3$ indicates the period of time that the bulbs are turned off.

(c) At the 10th time, $D_0=20$ and indicators $D_1$–$D_3$ indicate the starting time that the advertisement light bulbs are illuminated by the hour, minute and second.

(d) At the 11th time, $D_0=30$ and indicators $D_1$–$D_3$ indicate the starting time that the advertisement light bulbs will be turned off, also by the hour, minute and second.

(e) At the 12th time, $D_0=40$ and indicators $D_1$–$D_3$ indicate the present time by the hour, minute and second.

(f) At the 13th and following times, the above mentioned cycle is repeated. The # key is used to start or complete the key reading word. When this key is depressed for the first time, the program enters the read key, which illuminates the display, and when the second time the key is depressed, the key reading is stopped and the display is off. When $D_0=20$, 30 or 40, the key A can be pressed to set the "hour", key B can be pressed to set the "minute" while key C can be pressed to set the "second". If the keys * and # are pressed at the same time, the set data is transmitted from terminals P24–P27 and the output is converted by tone generator 47 and transmitted to tone decoder 42 in FIG. 7.

Figure 9:
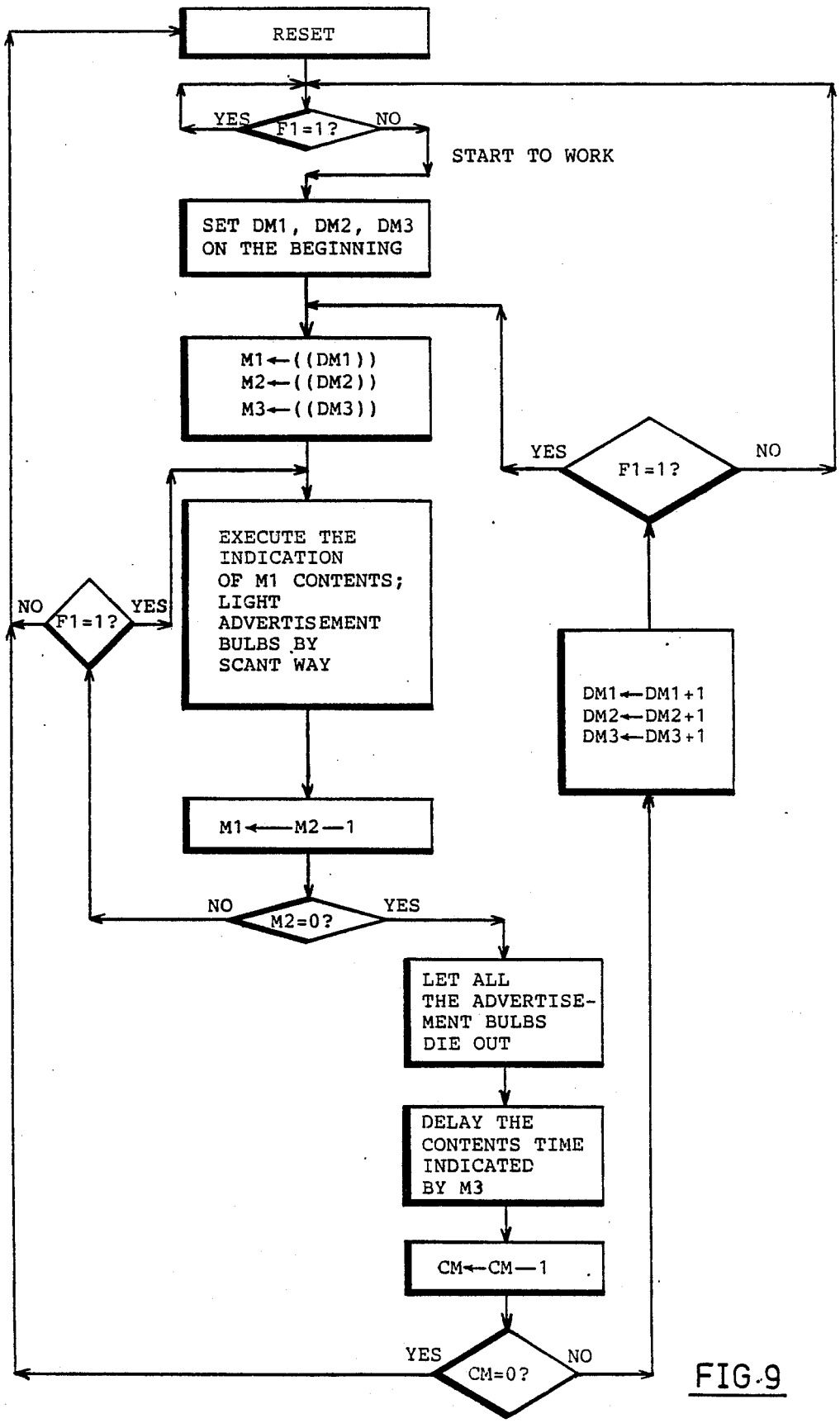
FIG. 9 is a flow chart showing the logic for controlling the operation of the circuit diagram shown in FIG. 6 by the control circuit shown in FIG. 7.
Figure 10:
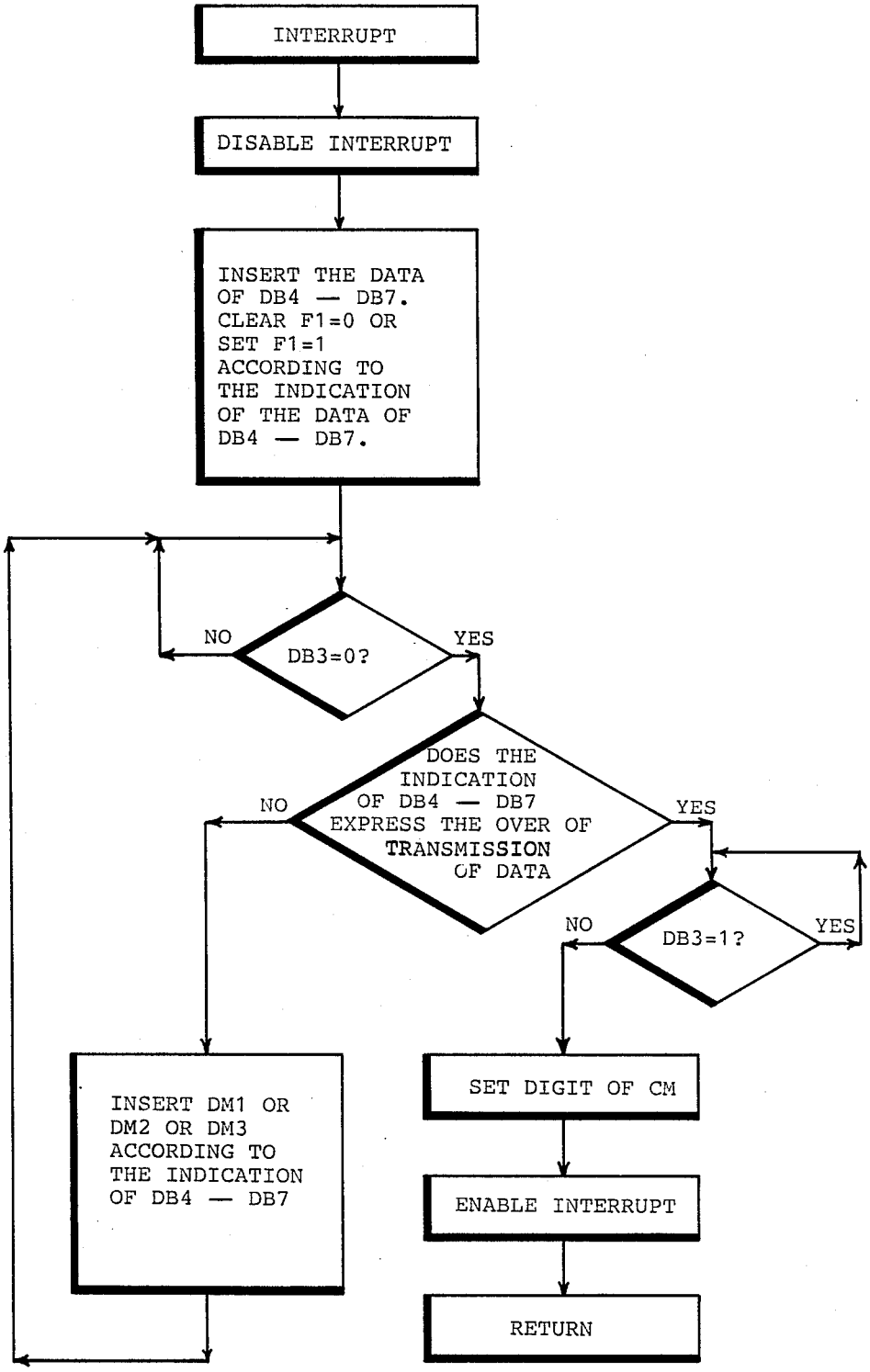
FIG. 10 is a cutoff service flow chart during the acceptance of the data shown in FIG. 7.

FIGS. 9 and 10 show flow charts of the logic system for carrying out these functions. FIG. 10 is the flow chart of the cutoff service type of the reception of the signals of the program from terminals $DB_4$–$DB_7$ for tone decoder 42 as shown in FIG. 7, when the preset multiple frequency signals enter. If the multiple frequency signals at terminal T (shown in FIGS. 7 and 8) carry significances and meanings, the terminal S of tone decoder 42 transmits an advice signal to terminal $DB_3$ and INT. Since INT is the program cutoff demand line, the program therefore temporarily stops the work of its main program, thereby entering the flow work as shown in this Figure.

The foregoing description is provided for illustrative purposes only and should not be construed as in any way limiting this invention, the scope of which is defined solely by the appended claims.

What is claimed is:

1. A system for an advertisement board comprising:

(a) a plurality of illuminating units arranged on an advertising board in a predetermined pattern, each illuminating unit comprising:

(i) a stationary support mounted on the advertising board;

(ii) a shaft rotatably mounted on the stationary support;

(iii) a fan blade mounted on the shaft such that wind acting on the fan blade causes rotation of the blade and shaft;

(iv) electrical generating means mounted between the support and the shaft such that, electrical power is produced as the shaft rotates; and, (v) light bulb means mounted on the shaft and normally electrically connected to the electrical generating means.

(b) an electrical power handling circuit means connected to the electrical generating means so as to store electical power generated by the generating means, the power handling circuit comprising (i) an auxiliary electrical power source;

(ii) connecting means electrically connecting the auxiliary electrical power source to the light bulb means; and (iii) switch means interposed between the auxiliary power source, the generating means and the light bulb means so as to automatically connect the light bulb means to the auxiliary power source and disconnect it from the generating means if the electrical power produced by the generating means falls below a predetermined level; and, (c) control means connected between the electrical power handling circuit means and the light bulb means to control the illumination of each of the light bulbs, such that, at any given time, only a portion of the total number of light bulbs are illuminated, the control means comprising:

(i) data storage means to store data relating to the time and duration of illumination for each of the light bulbs; and (ii) input means to input data into the data storage means relating to the time and duration of illumination for each light bulb.

2. The advertisement board system according to claim 1 wherein each illuminating unit further comprises one-way clutch means interposed between the shaft and the stationary support such that the shaft will only rotate in a predetermined direction.

3. The advertisement board system according to claim 2 further comprising a reflective coating applied to the fan blades.

4. The advertisement board system according to claim 1 further comprising a second fan blade mounted on an opposite end of the shaft from the other fan blade.

5. The advertisement board system according to claim 1 wherein the data input means is located remotely from the advertisement board and further comprising data transmission means interconnecting the data input means and the data storage means.

* * * * *